US005716014A

United States Patent [19]

Tamura et al.

[11] Patent Number: 5,716,014

[45] Date of Patent: Feb. 10, 1998

[54] SELF-ADVANCING CRUSHING MACHINE

[75] Inventors: Yukio Tamura; Toru Nakayama; Yuji Ozawa, all of Kawasaki, Japan

[73] Assignee: Komatsu Ltd., Tokyo, Japan

[21] Appl. No.: 586,793

[22] PCT Filed: Aug. 12, 1994

[86] PCT No.: PCT/JP94/01345

§ 371 Date: Feb. 1, 1996

§ 102(e) Date: Feb. 1, 1996

[87] PCT Pub. No.: WO95/05243

PCT Pub. Date: Feb. 23, 1995

[30] Foreign Application Priority Data

Aug. 13, 1993 [JP] Japan ..... 5-44416 U
Aug. 13, 1993 [JP] Japan ..... 5-44417 U

[51] Int. Cl.[6] ..... B02C 21/02

[52] U.S. Cl. ..... 241/36; 241/101.74; 241/224

[58] Field of Search ..... 241/224, 101.74, 241/36

[56] References Cited

U.S. PATENT DOCUMENTS 4,269,364 5/1981 Moriconi et al. ..... 241/36
5,476,227 12/1995 Tamura et al. .
5,580,004 12/1996 Tamura et al. .

FOREIGN PATENT DOCUMENTS 582615 4/1989 Australia .
77553 4/1988 Japan .
32744 3/1989 Japan .
130859 12/1991 Japan .
4-61939 2/1992 Japan .
31395 2/1993 Japan .
277555 10/1994 Japan .

OTHER PUBLICATIONS

Patent Abstracts of Japan, vol. 016, No. 261 (C–0950), Jun. 12, 1992 (Kyokuto Kaihatsu Kogyo Co., Ltd.).
Self Propelling Dual–Axis Shear, Komatsu Ltd., May 1993.

*Primary Examiner*—Mark Rosenbaum
*Attorney, Agent, or Firm*—Frishauf, Holtz, Goodman, Langer & Chick

[57] ABSTRACT

A self-advancing crushing machine includes a vehicle body, a travelling structure mounted to the vehicle body, a crusher mounted to the vehicle body and provided with a rotational shaft arranged horizontally and adapted to support a rotational blade, and a crusher motor unit having an output shaft mechanically coupled directly with a rotational shaft of the crusher. The mounting of the crusher motor unit to the vehicle body is achieved by a vehicle body side support structure fixedly secured to the vehicle body and a support member fixed to the crusher motor unit and adapted to support the crusher motor unit on the vehicle body through a mechanical coupling with the vehicle body side support structure.

15 Claims, 10 Drawing Sheets

SELF-ADVANCING CRUSHING MACHINE

TECHNICAL FIELD

The present invention relates to a self-advancing crushing machine for crushing wrecks or the like at, for example, building sites wherein portions of the wrecks or the like are to be crushed. The present invention also relates to a mounting structure of a crusher motor for driving the crusher of the self-advancing crushing machine for crushing the wrecks or the like.

PRIOR ART

As disclosed in Japanese Utility Model Laid-open Publication No. SHO 64-32744 and Japanese Patent Laid-open Publication No. SHO 63-77553, a self-advancing crushing machine is known in which a crusher, a hopper and a driving device are mounted to a vehicle body provided with a pair of bilateral travelling members, wherein a discharge conveyer is disposed to be tiltable between the paired travelling members at a lower portion of the vehicle body.

The self-advancing crushing machines disclosed in the above prior art publications can self advance through the rotation of crawler belts or wheels and finely crush materials to be crushed such as concrete or the like projected into a hopper, and the crushed pieces are discharged outside the vehicle body by means of the discharge conveyer.

A crusher mounted to such self-advancing crushing machine is called a jaw-crusher and is provided with, as disclosed, for example, in Japanese Patent Laid-open Publication No. SHO 63-77553, a housing to which are provided a stationary receiving plate and a movable crushing plate, whereby the materials to be crushed are crushed between the stationary receiving plate and the movable crushing plate by swinging the movable crushing plate. However, the materials cannot be crushed finely by such crusher, and particularly, tires, wood chips and the like cannot be finely crushed.

Furthermore, the self-advancing crushing machine disclosed in Japanese Utility Model Laid-open Publication No. SHO 64-32744 is equipped with a crusher in which the materials to be crushed are charged above a housing, so that it is necessary to utilize an elongated stationary receiving plate and a movable crushing plate. Hence, the distance between the vehicle body and the upper surface of the housing is made long, and since a hopper is disposed at an upper portion of such housing, the entire vertical height of the crushing machine increases.

For this reason, it is possible that the total height of the vehicle and the crushing machine mounted thereon will exceed a prescribed height for a vehicle when the crushing machine is conveyed while being mounted on a body of the vehicle, and in such case, it is necessary to disassemble the hopper from the crushing machine, thereby creating a troublesome problem.

Still further, the self-advancing crushing machine disclosed in Japanese Utility Model Laid-open Publication No. SHO 64-32744 is of a type in which materials to be crushed are projected in the hopper such that the materials then directly fall down from the hopper and along it by the force of gravity, so that the amount of the materials to be fed into the crusher from the hopper varies per unit time according to the force of gravity acting on the materials or the amount of the materials projected into the hopper, resulting in unstable crushing operation of the crusher. In certain cases, moreover, the materials cannot be stably fed into the crusher because of clogging of the materials in the hopper, and when the hopper clogs with the materials, it is necessary for a worker or operator to enter the hopper to remove the clogging materials and carry out the maintenance thereof. Because of this reason, the height of the hopper is made low so that the worker can easily enter into the hopper, and accordingly, there is a possibility for the worker to erroneously enter the hopper during the working, thus creating a dangerous situation. In order to obviate such problem and ensure the safety of the worker during the working in the hopper, it is required to further locate an equipment or device therefor.

Furthermore, in the self-advancing crushing machine of the type described above, a crusher motor for driving the crusher is mounted to the vehicle body, and the crusher is driven by coupling an output shaft of the crusher motor to a driving shaft of the crusher through pulley and belt means. According to such structure, the power transmission efficiency may be made worse because of slipping between the pulley and the belt, and moreover, the pulley and the belt are located outside, thus affecting the outer appearance.

In order to solve such problem, it has been proposed to directly couple the output shaft of the crusher motor to the driving shaft of the crusher. However, in such arrangement, it is necessary to concentrically locate the output shaft of the crusher motor and the driving shaft of the crusher. In order to satisfy this necessity, it is necessary to mount the crusher motor with high accuracy to the vehicle body and to carry out the alignment of the shafts and it is therefore necessary to work the mounting surface of the vehicle body to which the crusher motor is mounted with high accuracy. Further, the centering operation of the crusher motor involves a troublesome problem because of the heavy weight of the crusher motor itself.

DISCLOSURE OF THE INVENTION

Thus, the general object of the present invention is to provide a self-advancing crusher machine for solving the problems described above.

More concretely, a first object of the present invention is to provide a self-advancing crushing machine having a reduced vertical height between the vehicle body and the housing of the crusher by horizontally mounting the rotational shaft of the crusher, and even in an arrangement in which the hopper is attached to the upper surface of the housing, the total height of the crusher machine can be made small, thereby allowing the crusher to mount on the body of the vehicle at the conveyance thereof.

A second object of the present invention is to provide a self-advancing crushing machine in which a pair of rotational shafts of the crusher are mounted so as to be directed in the longitudinal direction of the vehicle body so that the crusher is disposed within the width length of the vehicle body even if the width be made small, thereby making compact the self-advancing crushing machine itself and being capable of easily travelling the crushing machine in a restricted working field.

A third object of the present invention is to provide a self-advancing crushing machine capable of preventing materials to be crushed from erroneously falling on a crusher motor or power unit.

A fourth object of the present invention is to provide a self-advancing crushing machine capable of concentrically coupling an output shaft of the crusher motor to the driving shaft of the crusher without performing the alignment thereof at the mounting of the crusher motor.

A fifth object of the present invention is to provide a self-advancing crushing machine capable of finely crushing the materials fed through the hopper by means of a rotating blade provided for the paired rotational shafts and minutely crushing tires and wood chips, thereby easily performing an after-treatment.

A sixth object of the present invention is to provide a self-advancing crushing machine capable of preventing workers from erroneously entering the hopper, and safely entering the hopper at the time of maintenance or inspection thereof.

In order to achieve the above objects, according to a first structure of the present invention, there is provided a self-advancing crushing machine characterized in that a crusher mounted with a pair of rotational shafts provided with a rotational blade in a housing is mounted to a vehicle body having a pair of bilateral travelling members in a width direction of the vehicle body with the rotational shafts being horizontally arranged and a hopper is mounted to an upper surface of the housing.

According to a second structure of the present invention, there is provided a self-advancing crushing machine characterized in that a crusher mounted with a pair of rotational shafts provided with a rotational blade in a housing is mounted to a front end side of a vehicle body having a pair of bilateral travelling members in a width direction of the vehicle body with the rotational shafts being horizontally arranged in a longitudinal direction of the vehicle body, a hopper is mounted to an upper surface of the housing, a power unit is disposed on a rear end side of the vehicle body, a crusher motor unit is disposed between the crusher and power unit, and an output shaft of the crusher motor unit is coupled with one of the rotational shafts.

According to a third structure of the present invention, there is provided a self-advancing crushing machine characterized in that a crusher mounted with a pair of rotational shafts provided with a rotational blade in a housing is mounted to a front end side of a vehicle body having a pair of bilateral travelling members in a width direction of the vehicle body with the rotational shafts being horizontally arranged in a longitudinal direction of the vehicle body, a hopper is mounted to an upper surface of the housing, a power unit is disposed on a rear end side of the vehicle body, a crusher motor unit is disposed between the crusher and the power unit, and an output shaft of the crusher motor unit is coupled with one of the rotational shafts, the hopper being composed of a front vertical panel, a rear vertical panel, a left vertical panel and a right vertical panel so as to provide a rectangular shape, the rear vertical panel having a vertical attitude higher than those of the other vertical panels.

In the structures described above, a belt conveyer may be disposed below the crusher between the paired bilateral travelling members.

According to a fourth structure of the present invention, there is provided a self-advancing crushing machine characterized in that a crusher mounted with a pair of rotational shafts provided with a rotational blade in a housing is mounted to a vehicle body having a pair of bilateral travelling members in a width direction of the vehicle body with the rotational shafts being substantially horizontally arranged and a hopper is mounted to an upper surface of the housing.

According to a fifth structure of the present invention, there is provided a self-advancing crushing machine characterized in that a crusher mounted with a pair of rotational shafts provided with a rotational blade in a housing is mounted to one longitudinal end side of a vehicle body having a pair of bilateral travelling members in a width direction of the vehicle body with the rotational shafts being substantially horizontally arranged in a longitudinal direction of the vehicle body, a hopper is mounted to an upper surface of the housing, a power unit is disposed on another one longitudinal end side of the vehicle body, a crusher motor unit is disposed between the crusher and the power unit, and an output shaft of the crusher motor unit is coupled with one of the rotational shafts.

According to a sixth structure of the present invention, there is provided a self-advancing crushing machine characterized in that a crusher mounted with a pair of rotational shafts provided with a rotational blade in a housing is mounted to one longitudinal end side of a vehicle body having a pair of bilateral travelling members in a width direction of the vehicle body with the rotational shafts being substantially horizontally arranged in a longitudinal direction of the vehicle body, a hopper is mounted to an upper surface of the housing, a power unit is disposed on another one longitudinal end side of the vehicle body, a crusher motor unit is disposed between the crusher and the power unit, and an output shaft of the crusher motor unit is coupled with one of the rotational shafts, the hopper being composed of a plurality of vertical panels so as to provide a rectangular shape in which one of the vertical panels disposed on the crusher motor unit side has an vertical attitude higher than those of the other vertical panels.

According to a seventh structure of the present invention, there is provided a self-advancing crushing machine characterized in that a crusher mounted with a pair of rotational shafts provided with a rotational blade in a housing is mounted to a longitudinal intermediate portion of a vehicle body having a pair of bilateral travelling members in a width direction of the vehicle body with the rotational shafts being substantially horizontally arranged in a longitudinal direction of the vehicle body, a hopper is mounted to an upper surface of the housing, a power unit is disposed on one longitudinal end side of the vehicle body, a crusher motor unit is disposed on another one longitudinal end side of the vehicle body, and an output shaft of the crusher motor unit is coupled with one of the rotational shafts.

According to an eighth structure of the present invention, there is provided a self-advancing crushing machine characterized in that a crusher mounted with a pair of rotational shafts provided with a rotational blade in a housing is mounted to a longitudinal intermediate portion of a vehicle body having a pair of bilateral travelling members in a width direction of the vehicle body with the rotational shafts being substantially horizontally arranged in a longitudinal direction of the vehicle body, a hopper is mounted to an upper surface of the housing, a power unit is disposed on one longitudinal end side of the vehicle body, a crusher motor unit is disposed on another one end side of the vehicle body, and an output shaft of the crusher motor unit is coupled with one of the rotational shafts, the hopper being composed of a plurality of vertical panels so as to provide a rectangular shape in which one of the vertical panels disposed on a side opposite to the crusher motor unit side has an vertical attitude higher than those of the other vertical panels.

In the structures described above, a belt conveyer may be disposed below the crusher between the paired bilateral travelling members.

According to a ninth structure of the present invention, there is provided a structure for mounting a crusher motor unit of a self-advancing crushing machine in which a crusher is mounted to a vehicle body provided with a pair of bilateral travelling members and a hopper is mounted to the crusher, characterized in that an output shaft of a crusher motor unit is coupled with a driving shaft of the crusher and a reaction force receiving plate attached to the crusher motor unit is supported by brackets secured to the vehicle body.

In this structure, upper and lower push pieces are mounted to the brackets with a space therebetween and the reaction force receiving plate is disposed between the upper and lower push pieces in a supported manner.

According to a tenth structure of the present invention, there is provided a self-advancing crushing machine characterized in that a crusher mounted with a pair of rotational shafts provided with a rotational blade in a housing is mounted to a vehicle body having a pair of bilateral travelling members in a width direction of the vehicle body with the rotational shafts being substantially horizontally arranged in a longitudinal direction of the vehicle body and a hopper is mounted to an upper surface of the housing, and in that the hopper is composed of a plurality of vertical panels each having a vertical attitude such that a worker on the vehicle body does not enter the hopper, an opening for maintenance is formed to the vertical panel and a door is secured to the opening to open or close the opening.

In this structure, a sensor is provided for detecting an opening operation of the door and a crusher motor unit is stopped in its operation by a signal from the sensor which detects the opening of the door.

According to an eleventh structure of the present invention, there is provided a self-advancing crushing machine characterized by comprising:

a vehicle body;

a travelling structure mounted to the vehicle body;

a crusher mounted to the vehicle body and provided with a rotational shaft arranged horizontally and adapted to support a rotational blade;

a crusher motor unit having an output shaft mechanically coupled directly with a rotational shaft of the crusher;

a vehicle body side support structure fixedly secured to the vehicle body; and a support member fixed to the crusher motor unit and adapted to support the crusher motor unit on the vehicle body through a mechanical coupling with the vehicle body side support structure.

In this structure, the vehicle body side support structure is composed of a pair of brackets fixed to the vehicle body and the support member fixed to the crusher motor unit is fitted to the brackets so as to secure the crusher motor unit to the vehicle body, and the support member may be composed of a reaction force receiving plate.

BRIEF DESCRIPTION OF THE DRAWINGS

The present invention will be better understood from the following detailed description and accompanying drawings showing embodiments of the present invention. Further, the embodiments shown in the drawings are not intended to limit the scope of the present invention and are provided for easy understanding of the following description.

In the accompanying drawings.

BEST MODE FOR EMBODYING THE INVENTION

Figure 1:
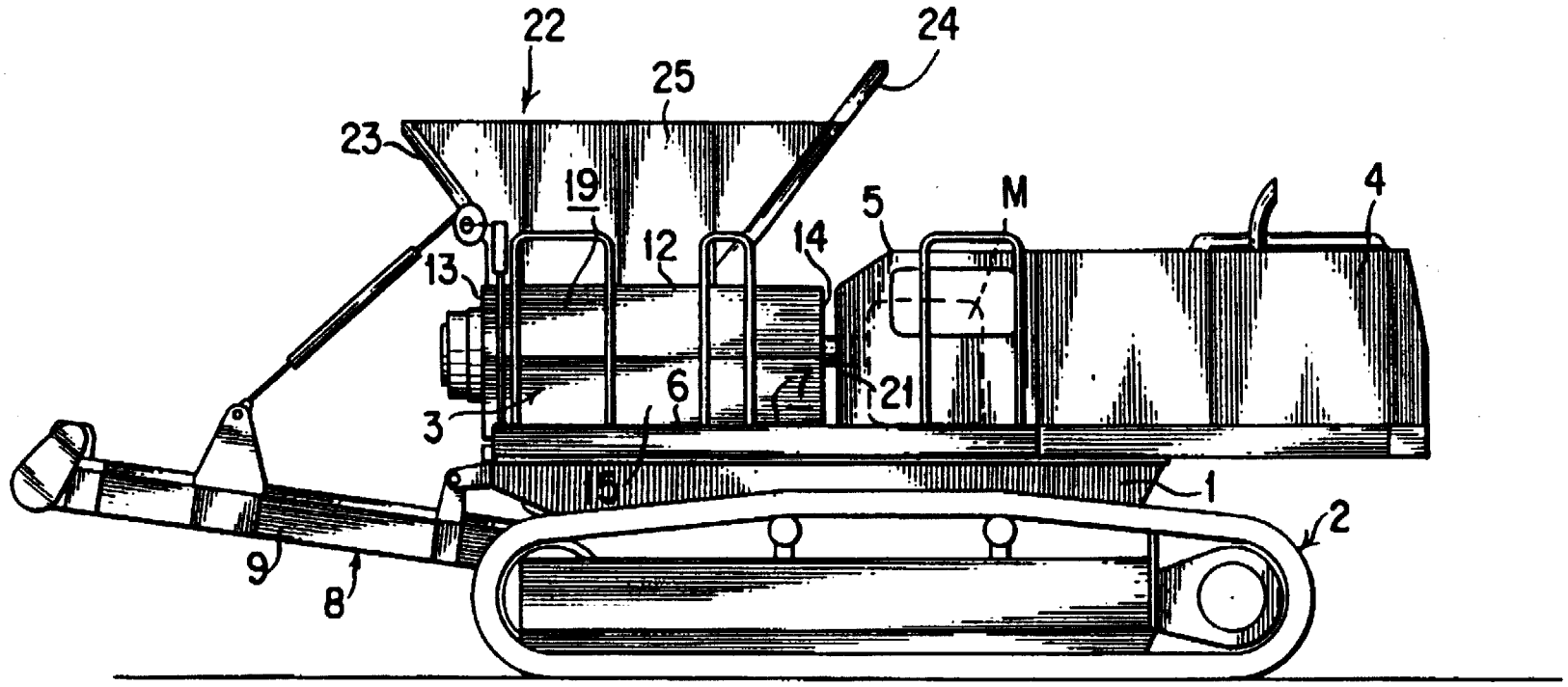
FIG. 1 is a front view of a self-advancing crushing machine according to an embodiment of the present invention.
Figure 2:
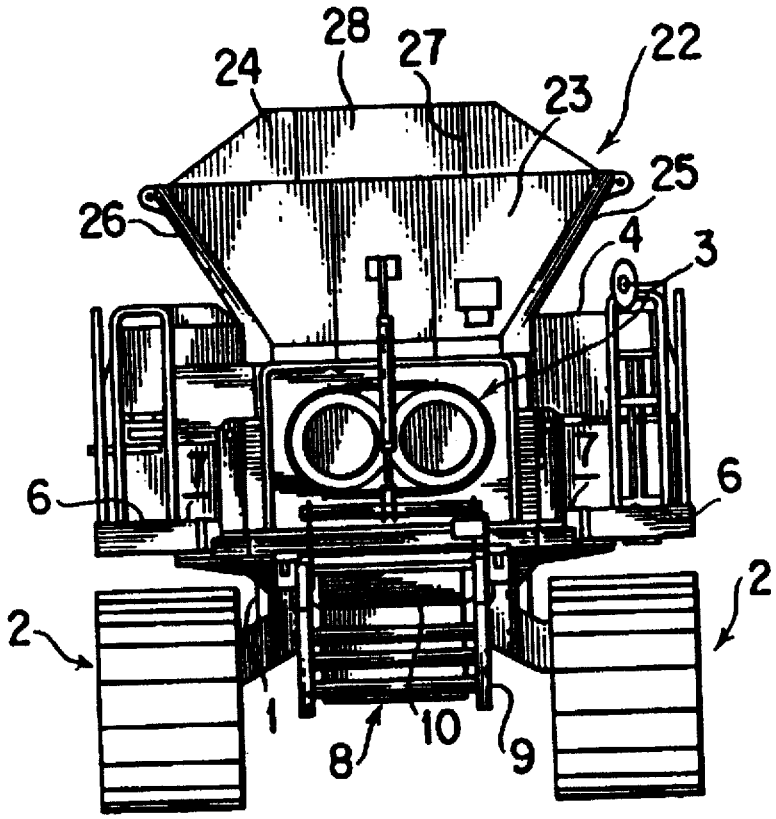
FIG. 2 is a left side view of the self-advancing crushing machine according to the embodiment of the present invention.
Figure 3:
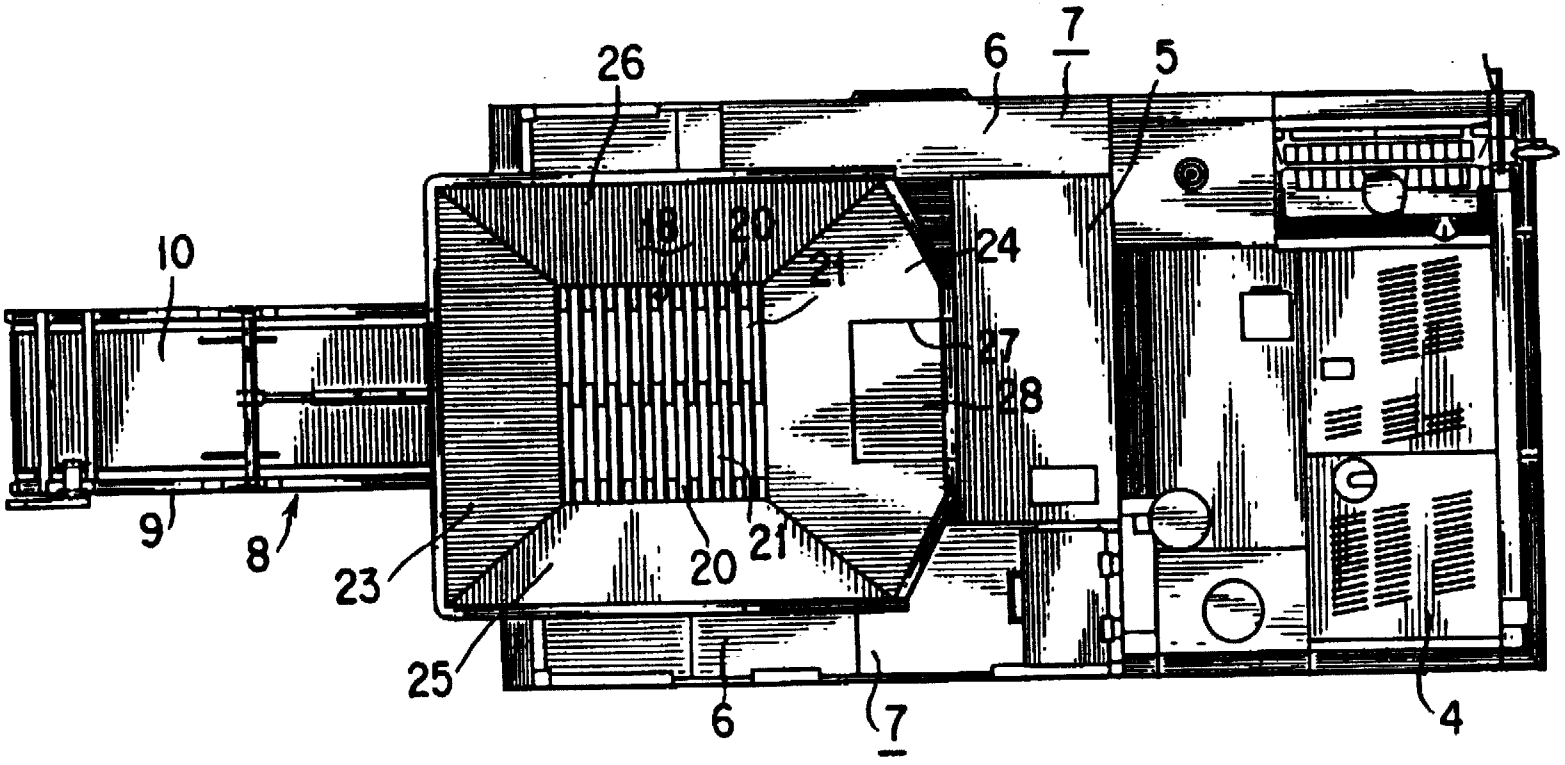
FIG. 3 is a plan view of the self-advancing crushing machine according to the embodiment of the present invention.

Hereunder, preferred embodiments of the present invention will be described with reference to the accompanying drawings. Further, in the following description, various elements are described in detail for the aid of complete understanding of the present invention. However, the present invention can be practiced by those skilled in the art without using the specific structures described herein, and descriptions concerning well known structures are omitted hereunder for the sake of avoiding an unnecessarily ambiguous and narrow disclose.

Further, it is to be noted that disclosures in the PCT Application No. PCT/JP93/01312 filed on Sep. 14, 1993, the PCT Application No. PCT/JP93/01313 filed on Sep. 14, 1993, and the PCT Application No. PCT/ JP94/00298 filed on Feb. 24, 1994, are assigned to the same entity and the entire contents thereof are incorporated herein by reference.

As shown in FIGS. 1 to 4, a pair of travelling members 2 are mounted to both bilateral sides of a vehicle body 1. A crusher 3 is mounted to one end side portion in the longitudinal direction of the vehicle body 1. A cover 4 is provided on the other one end side portion thereof, and an auxiliary cover 5 is also provided on an intermediate portion of the vehicle body 1 in the longitudinal direction thereof. Step boards 6 are mounted to the auxiliary cover 5 and the bilateral sides of the crusher 3 to thereby constitute working platforms 7 on both sides of the crusher 3 and the auxiliary cover 5, respectively. A belt conveyer 8 is mounted between the bilateral pair of travelling members 2, 2, and the belt conveyer 8 is constituted by an endless belt 10 stretched over a frame 9, which is connected to the lower portion of the vehicle body 1.

Figure 4:
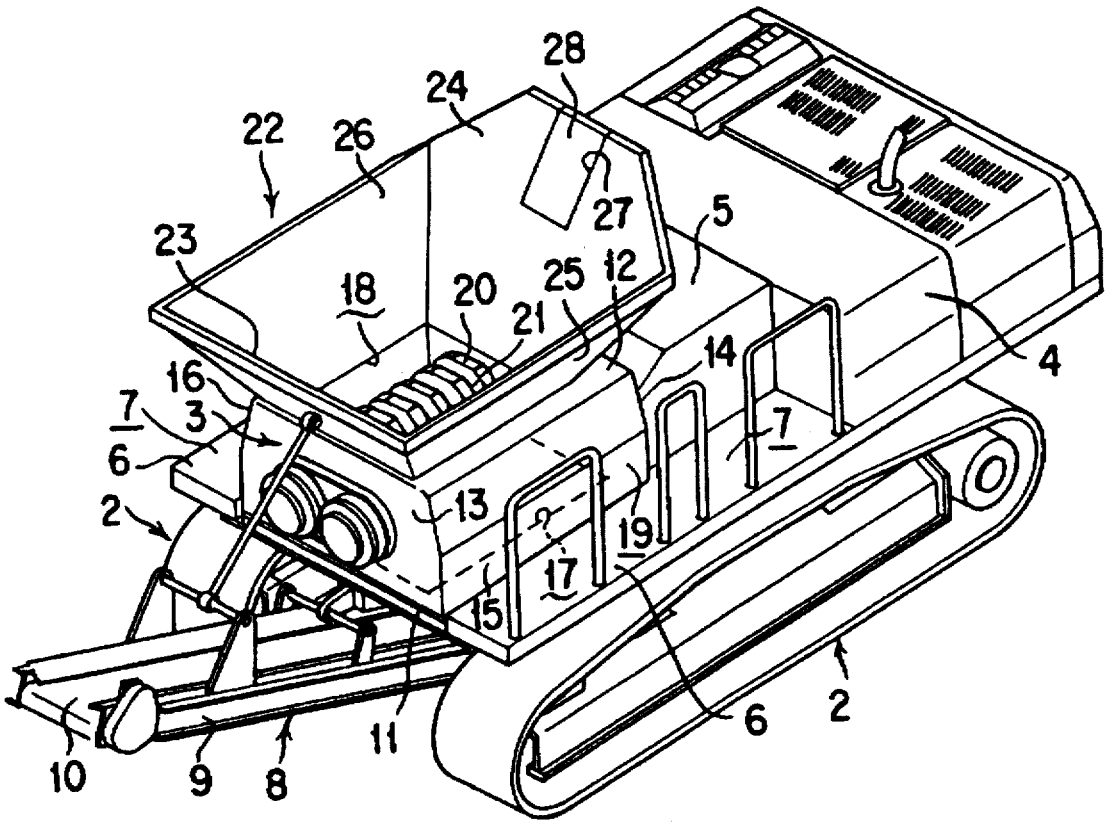
FIG. 4 is a perspective view of the self-advancing crushing machine according to the embodiment of the present invention.

As shown in FIG. 4, the crusher 3 has a housing 19 which is composed of a bottom panel 11, an upper panel 12, a front panel 13, a rear panel 14, a right panel 15 and a left panel 16. The bottom panel 11 is formed with a discharge port 17 and the upper panel 12 is formed of a charging port 18. A pair of rotational shafts 21 mounted with a rotating blade 20 are disposed horizontally to be rotatable between the front and rear panels 13 and 14 of the housing 19. The crusher 3 is mounted to the vehicle body 1 with the paired rotational shafts 21 being juxtaposed horizontally in the longitudinal direction of the vehicle body 1. According to this structure, the width length of the crusher 3 is made small and the longitudinal length thereof is made large so that the crusher 3 is prevented from projecting over its width length.

A hopper 22 is mounted to the peripheral edge of an opening of the charging port 18 formed to the upper panel 12 of the housing 19, and the hopper 22 is composed of a front vertical panel 23, a rear vertical panel 24, a right vertical panel 25 and a left vertical panel 26 so as to provide a rectangular shape upper opening widened in a funnel-like shape. The rear vertical panel 24 has a vertical attitude higher than those of the other vertical panels and is provided with an opening 27 for maintenance to which a door 28 is attached.

Further, the discharge port 15 of the bottom panel 11 of the housing 19 has an opened edge to which a discharge chute, not shown, is attached, through which crushed materials fall on the belt conveyer 8 to then discharge them.

An engine unit, a hydraulic pump unit and a power unit for a directional control valve for supplying hydraulic fluid are arranged inside the cover 4, and a motor unit M for the crusher 3 for driving the rotational shafts 21 is arranged inside the auxiliary cover 5.

Figure 5:
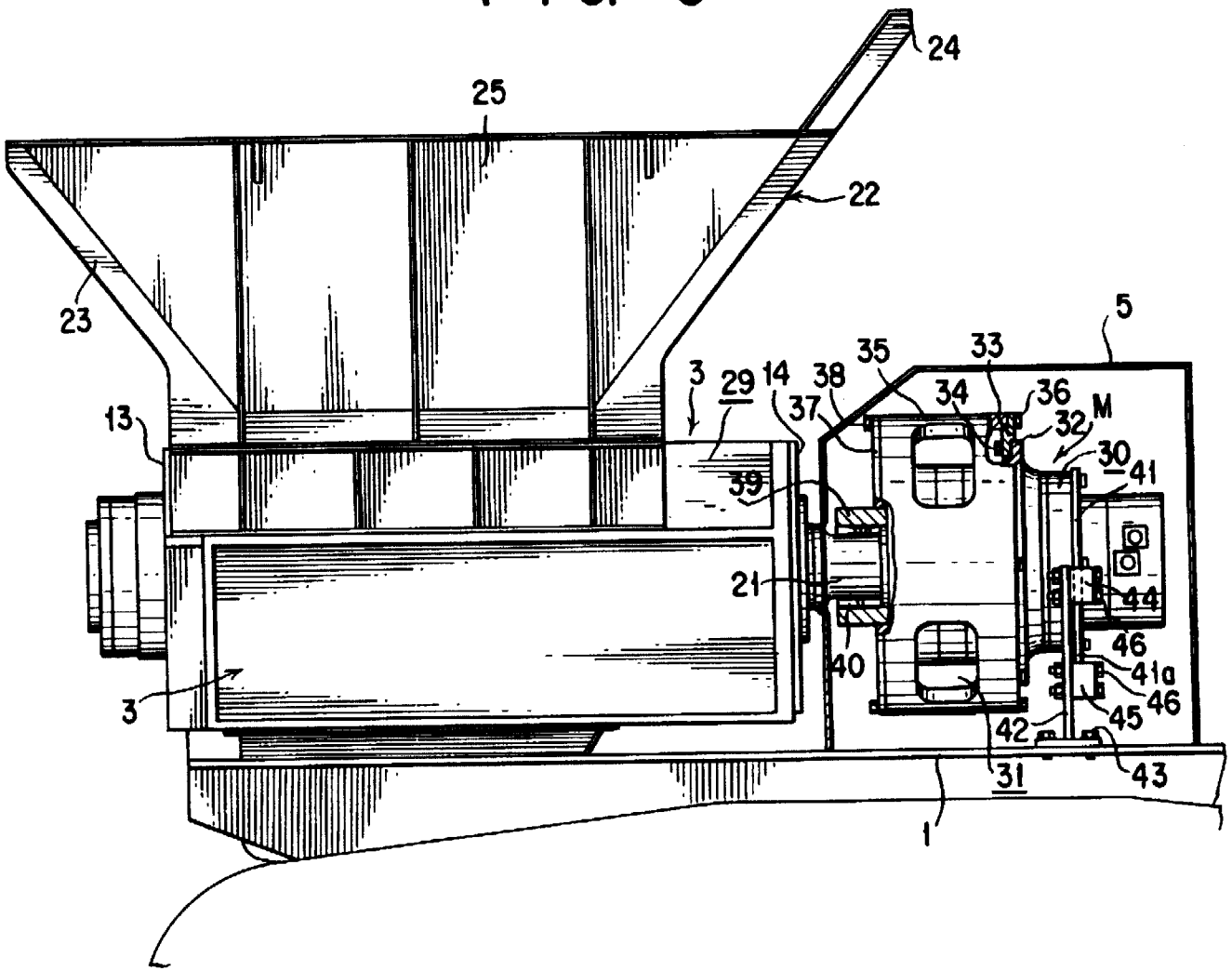
FIG. 5 is a front view of a crusher motor of the self-advancing crushing machine according to the embodiment of the present invention.
Figure 6:
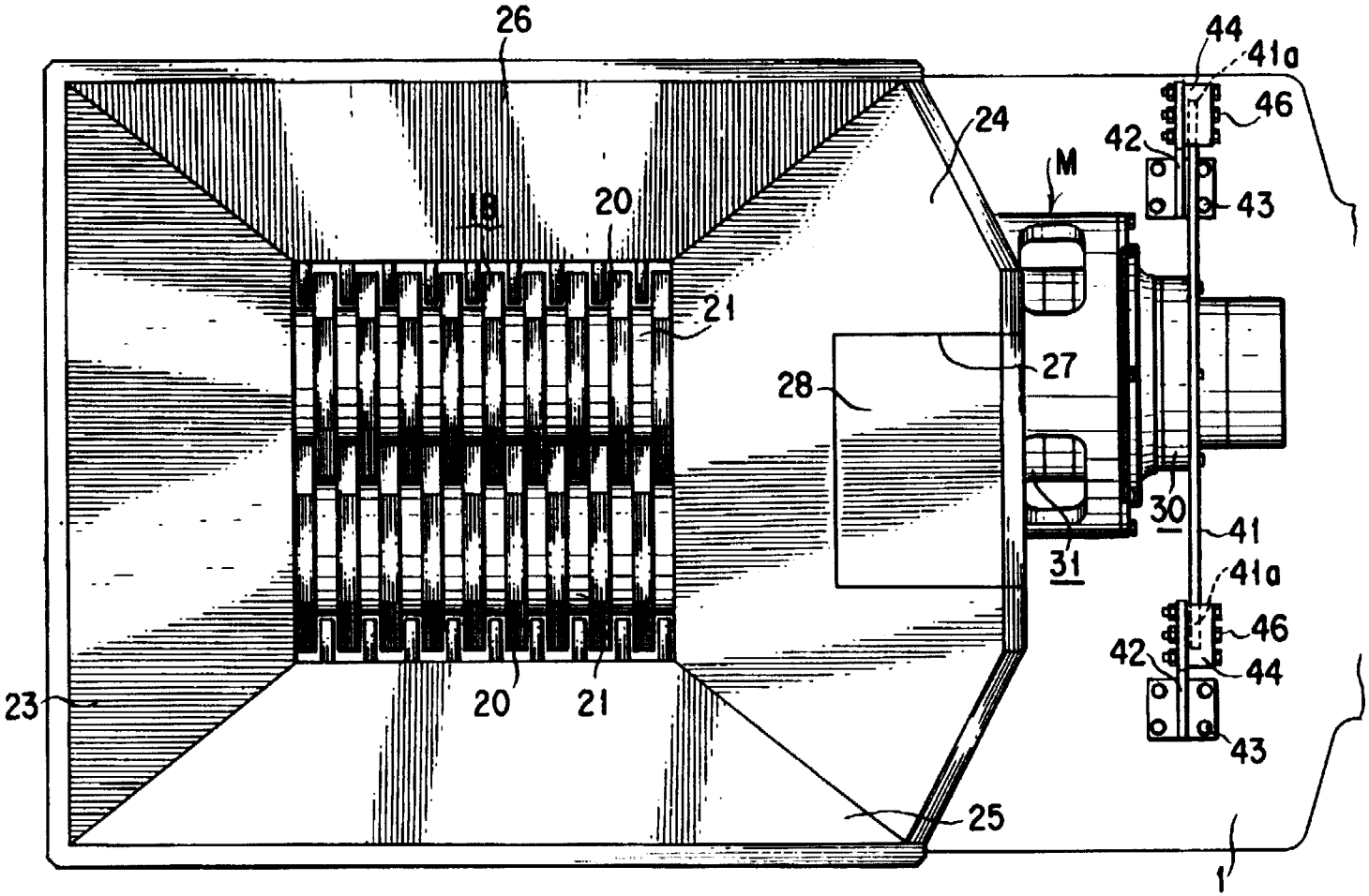
FIG. 6 is a plan view of a crusher motor mounting portion.

With reference to FIGS. 5 and 6, the crusher motor unit M comprises a hydraulic motor 30 and a speed reduction mechanism 31, and the speed reduction mechanism 31 has an output side outward flanged portion 32 to which one end plate 33 is fastened by means of bolt 34. A cylindrical casing 35 is coupled to the one end plate 33 by means of bolt 36. The other end plate 37 is fastened to the casing 35 by means of bolt 38 and a cylindrical member 39 is fastened to the other end plate 37. When the hydraulic oil is supplied to the hydraulic motor 30, the cylindrical member 39 is rotated. The cylindrical member 39 constitutes an output shaft of the crusher motor unit M in a manner that one of the rotational shafts 21 is inserted into the cylindrical member 39 and coupled through a coupling 40. The coupling 40 is composed of an inner ring and an outer ring which are coupled by inserting taper rings thereinto and fastened by means of bolts so that the inner ring is closely contacted to the rotational shaft 21 and the outer ring is closely contacted to the cylindrical member 39. According to such structure, the crusher motor unit M is connected to one of the rotational shafts 21 in a manner that this rotational shaft 21 is arranged concentrically with the cylindrical member 39.

Figure 7:
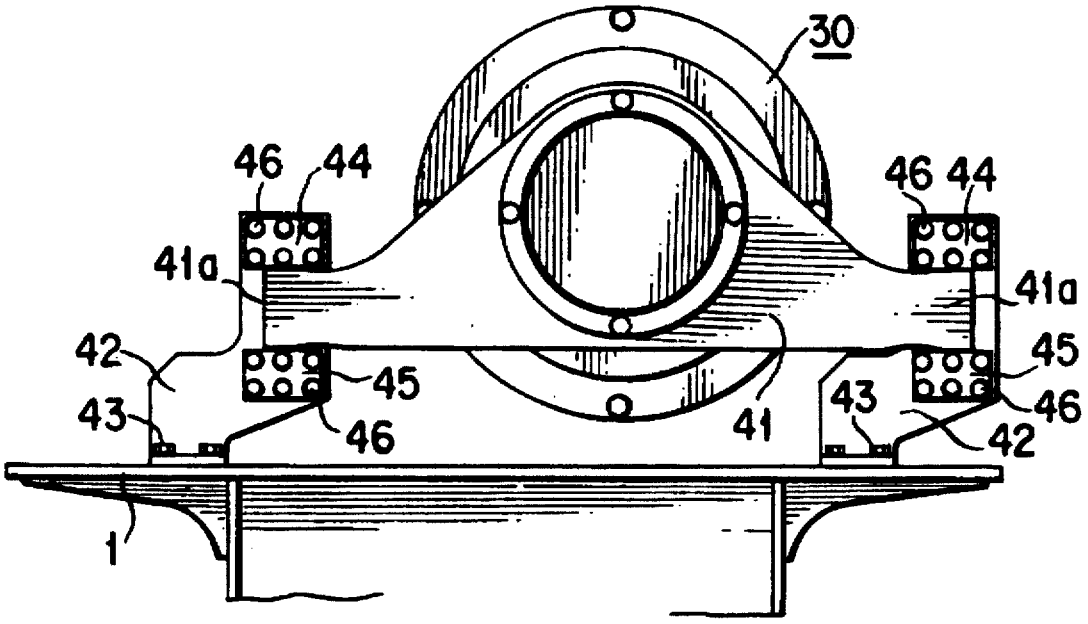
FIG. 7 is a right side view of the crusher motor mounting portion.

As shown in FIGS. 5 and 7, a reaction force receiving plate 41 is attached to the hydraulic motor 30, and a pair of brackets 42 are fixed on the vehicle body 1 by means of bolts 43 opposite to back ends 41*a* of the reaction force receiving plate 41. Upper and lower push pieces 44 and 45 are secured to the brackets 42 by means of bolts 46 in a manner that, as shown in FIGS. 5, 6 and 7, both the ends 41*a* of the reaction force receiving plate 41 are fitted between the upper and lower push pieces 44 and 45 thereby preventing the hydraulic motor 30 from being rotated with respect to the vehicle body 1 to bear the reaction force to the rotation of the crusher motor unit M by the vehicle body.

As described above, the cylindrical member 39 constituted as the output shaft of the crusher motor unit M and one of the rotational shafts 21 constituted as the crusher driving shaft are coupled concentrically with each other, and the reaction force receiving plate 41 attached to the crusher motor unit M is fitted and supported between the upper and lower push pieces 44 and 45, whereby it is not necessary to mount the crusher motor unit M to the vehicle body with high accuracy and also not necessary to perform the alignment.

Figure 8:
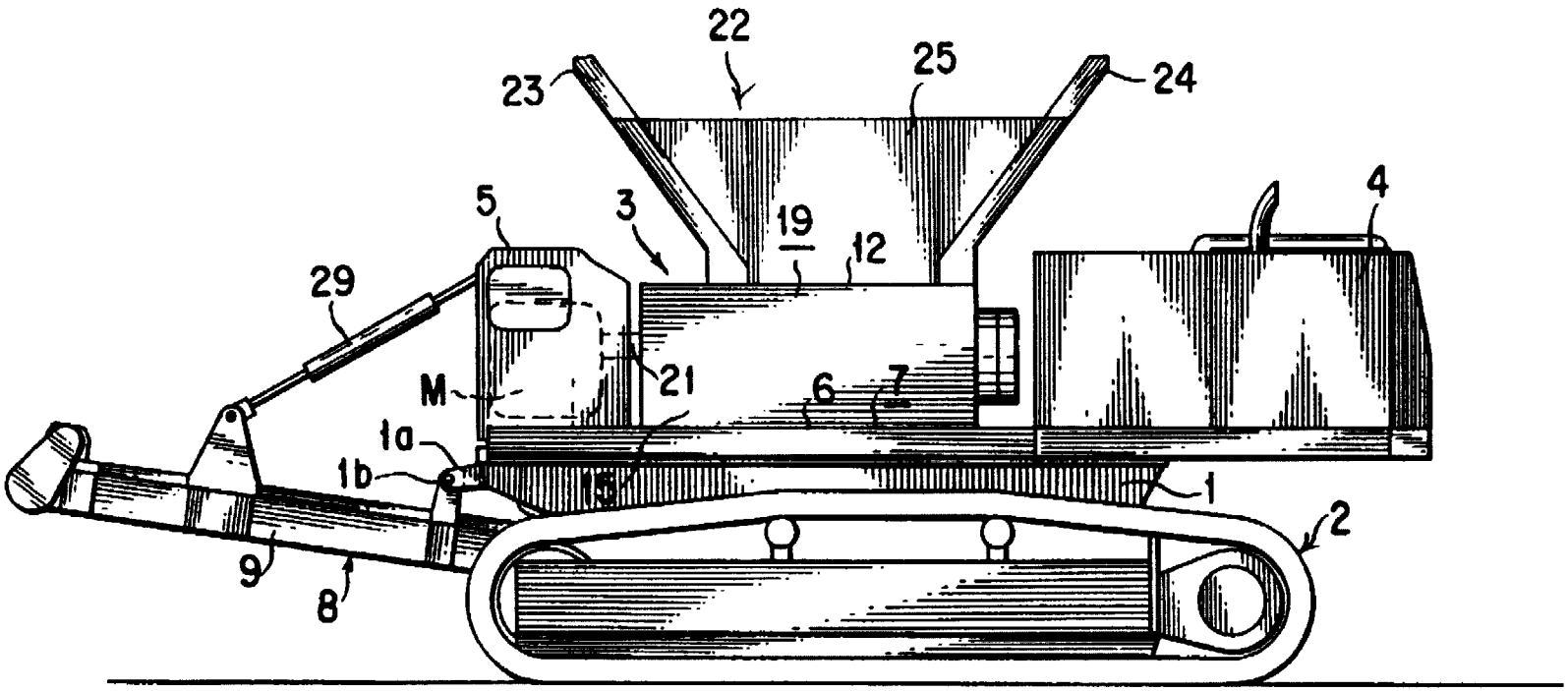
FIG. 8 is a front view of a self-advancing crushing machine according to another embodiment of the present invention.
Figure 9:
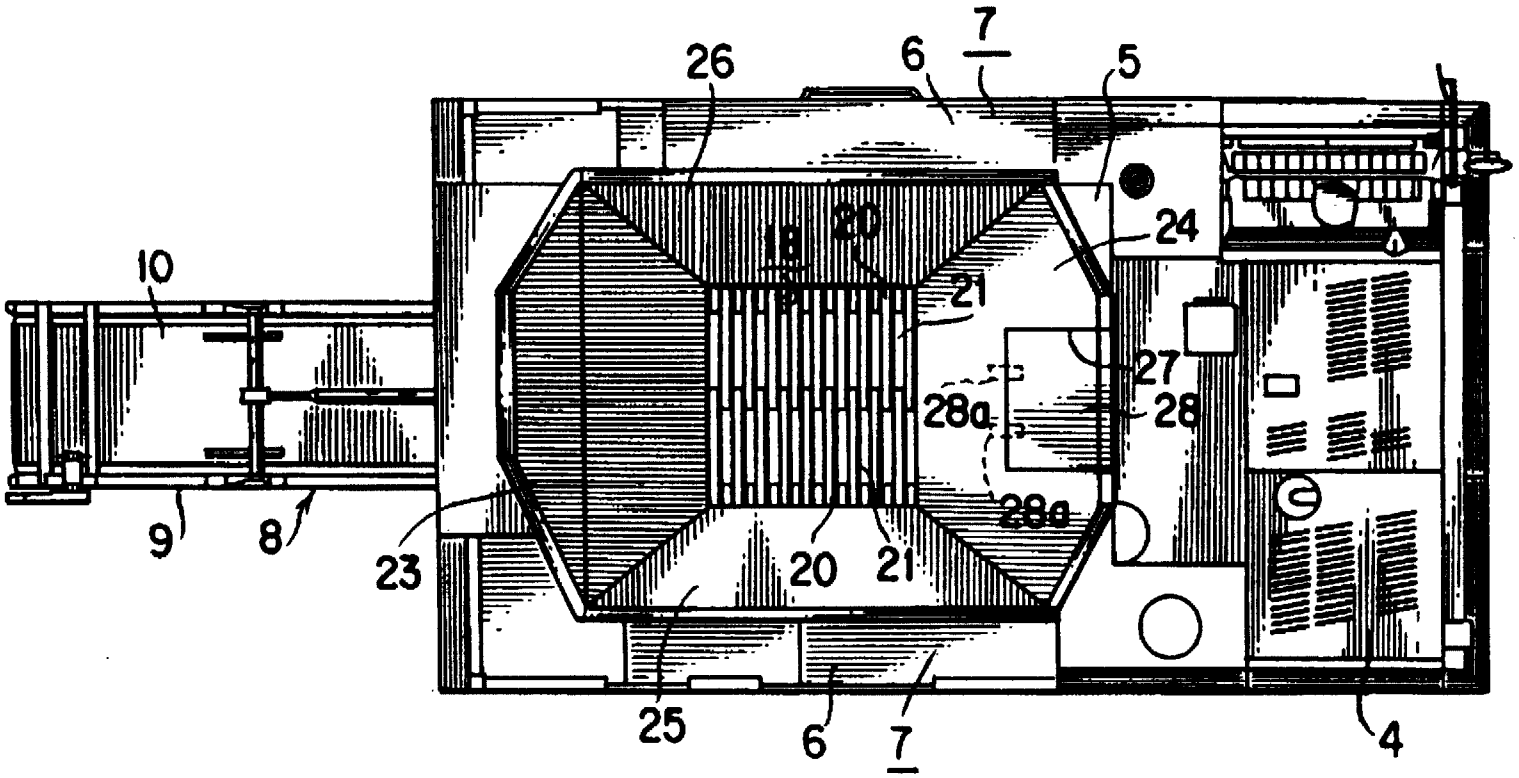
FIG. 9 is a plan view of the self-advancing crushing machine according to the other embodiment of the present invention.

FIGS. 8 and 9 represent another embodiment of the present invention, in which the crusher 3 is arranged at an intermediate portion in the longitudinal direction of the vehicle body 1, the auxiliary cover 5 and the crusher motor unit M are mounted to portions on one end side of the vehicle body 1 in the longitudinal direction thereof, and the cover 4 is mounted to a portion on the other one end side of the vehicle body in the longitudinal direction thereof. The other structures are substantially the same as those of the former embodiment.

Figure 10:
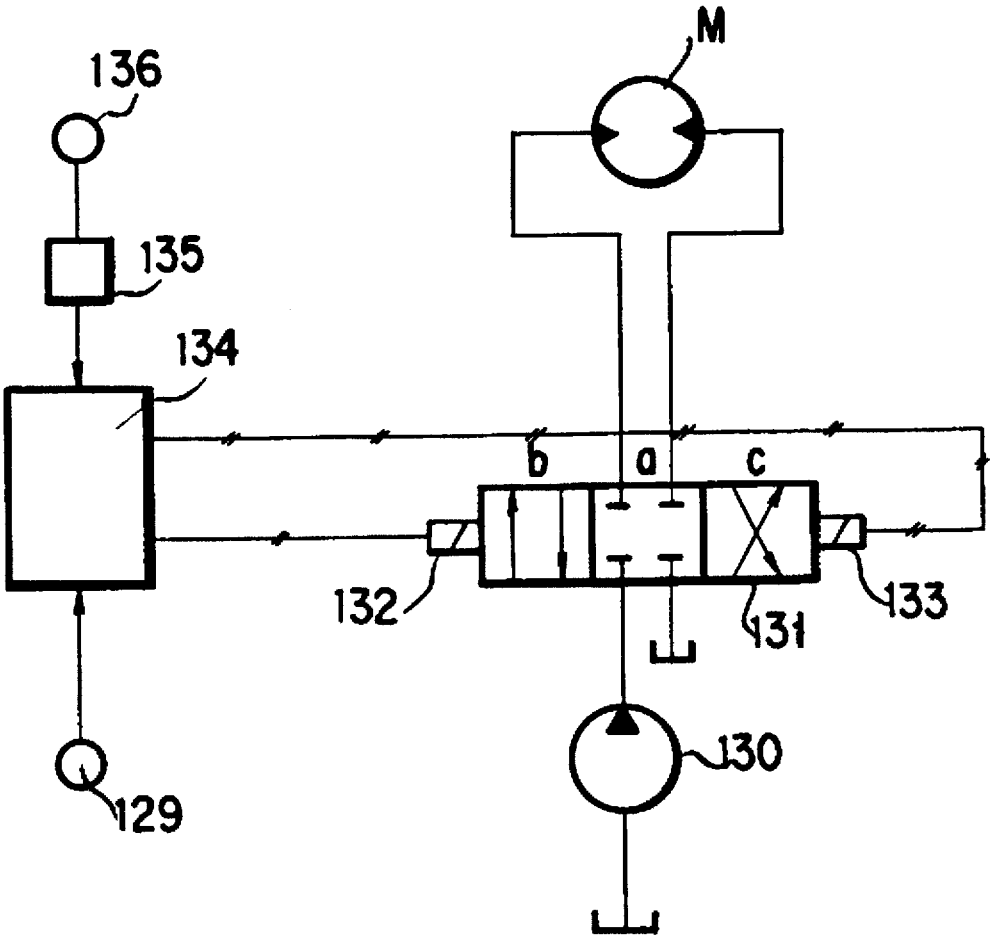
FIG. 10 is a circuit diagram of a driving circuit for the crusher motor.

As shown in FIG. 10, the crusher motor unit M is normally rotated, reversely rotated or stopped by supplying a drain hydraulic oil from a hydraulic pump 130 to a directional control valve 131. The directional control valve 131 is of an electro-magnetically switching type in which while the directional control valve 131 is usually supported at its neutral position a, the directional control valve is switched to a normal rotation position b or reverse rotation position c through the current conduction to first and second solenoids 132 and 133. The current conduction to the first and second solenoids 132 and 133 are controlled by a controller 134 to which signals representing the normal rotation, the reverse rotation and the stopping of the motor unit M are inputted through a wire or in a wireless manner from an operation box 135. Therefore, the normal rotation, the reverse rotation or the stopping of the motor unit M is controlled by operating an operation lever 136 of the operation box 135. A signal from a sensor 129 is inputted to the controller 134, which generates a stop signal, regardless of the signal from the operation box 135, when a door opening signal is inputted from the sensor 129, thereby stopping the operation of the crusher motor unit M.

According to the structure described above, the erroneous entering of the worker into the hopper 22 during the working can be prevented, and the worker can easily and safely enter into the hopper 22 through the maintenance opening 27 by opening the door 28. Furthermore, when the door 28 is opened, the operation of the crusher motor unit M is stopped, thus being safely operated.

The operation of the self-advancing crusher machine will be described hereunder.

The materials to be crushed charged through the hopper 22 is finely crushed by the rotating blades 20 of the paired rotational shafts 21 and the crushed material pieces are discharged outside the vehicle body 1 through the belt conveyer 8.

Since the crusher 3 is mounted to the vehicle body 1 so that the paired rotational shafts 21 of the crusher 3 are directed in the longitudinal direction of the vehicle body 1, the crusher 3 can be accommodated within the width length of the vehicle body even if the crusher 3 is constructed to have a narrow width, thus the entire structure of the crusher 3 being made compact, and hence, the crusher machine can be travelled and moved even in a narrow working field. Furthermore, since the crusher 3 is provided with the paired rotational shafts 21 horizontally, the distance between the vehicle body 1 and the upper surface of the housing 19 can be reduced, whereby the entire height of the crusher machine is made low even if the hopper is attached to the upper portion of the housing 19 and, accordingly, the total height of the crusher machine will not exceed the prescribed height limit even when it is carried on the truck body.

Still further, since the crusher 3 is arranged on the front end side of the vehicle body 1, the power unit is disposed on the rear end side thereof and the crusher motor unit M is disposed between the crusher 3 and the power unit, the crusher 3, the power unit and the crusher motor unit M are aligned in their arrangements in the longitudinal direction of the vehicle body 1, whereby the width length of the vehicle body can be made small.

In addition, since the rear vertical panel 24 constituting the hopper 22 is formed so as to have a height higher than those of the other vertical panels constituting the hopper 22, when the materials to be crushed are charged into the hopper 22 by, for example, a power shovel, the materials can be prevented from erroneously falling on the cover 4 and the auxiliary cover 5. The worker can enter the hopper 22 through the maintenance opening 27 by opening the door 28 of the rear vertical panel 24, so that the rotational blade 20 and the other members can be easily and safely maintained and changed.

Still further, the materials charged through the hopper 22 can be crushed finely by the rotating blade 20 mounted to the paired rotational shafts 21. Particularly, tires and wood chips can be finely crushed to make easy the after-treatment.

Since the paired rotational shafts 21 are mounted in the crusher 3 horizontally, the distance between the vehicle body 1 and the upper surface of the housing 19 can be made short, whereby the entire height of the crusher machine is made low even if the hopper is attached to the upper portion of the housing 19 and, accordingly, the total height of the crusher machine will not exceed the prescribed height limit even when it is carried on the truck body.

The rear vertical panel 24 constituting the hopper 22 is formed so as to have a height higher than those of the other vertical panels constituting the hopper 22, and accordingly, when the materials to be crushed are projected into the hopper 22 by, for example, a power shovel, the materials can be prevented from erroneously falling on the cover 4 and the auxiliary cover 5. Furthermore, the materials charged through the hopper 22 can be crushed finely by the rotating blade 20 mounted to the paired rotational shafts 21, and the crushed material pieces are discharged outside the vehicle body 1 through the conveyer belt 8.

Still further, according to the present invention, the driving shaft of the crusher and the output shaft of the crusher motor unit can be concentrically coupled without carrying out the alignment. In addition, the brackets 42 supporting the reaction force receiving plates 42 are mounted to the vehicle body 1, and the brackets 42 can be easily mounted to the vehicle body 1 without positioning.

Accordingly, the crusher motor unit M can be easily mounted to the vehicle body 1 and the driving shaft of the crusher and the output shaft of the crusher motor unit can be easily concentrically coupled with each other.

Furthermore, since the paired rotational shafts 21 are mounted in the crusher 3 substantially horizontally, the distance between the vehicle body 1 and the upper surface of the housing 19 can be made short, whereby the entire height of the crusher machine is made low even if the hopper is attached to the upper portion of the housing 19 and, accordingly, the total height of the crusher machine will not exceed the prescribed height limit even when it is carried on the truck body.

Still further, according to the structure of the present invention, the vertical panel of the hopper 22 on the crusher motor unit side or the vertical panel of the hopper 22 on the side opposite to the crusher motor unit side is made higher than those of the other side vertical panels, and accordingly, when the materials to be crushed are charged into the hopper 22 by, for example, a power shovel, the materials can be prevented from erroneously falling on the crusher motor unit or the power unit.

Still further, since the hopper 22 has an attitude to the extent that the worker cannot enter the hopper 22, the erroneous entering of the worker into the hopper 22 can be safely prevented, and on the other hand, when the door 28 is opened, the worker can enter the hopper through the maintenance opening 27 to easily maintain the inside of the hopper 22. Further, when the door 28 is opened, the crusher motor unit M can automatically stop, so that even if the worker enters the hopper 22, the rotational shafts 21 stop, thus keeping safe operation.

Further, although the present invention is described hereinbefore through exemplary embodiments, it should be apparent to those skilled in the art that many changes, deletions and additions may be made to the disclosed embodiments without departing from the spirit and scope of the present invention. Accordingly, it is to be noted that the present invention is not limited to the described embodiments, and that the scope of the present invention as defined by the elements recited in the appended claims includes equivalents thereof.

We claim:

1. A self-advancing crushing machine comprising:

a vehicle body having a pair of bilateral travelling members provided in a width direction of the vehicle body;

a crusher mounted to the vehicle body, said crusher including a housing and a pair of rotational shafts provided with a rotational blade in the housing, said rotational shafts being arranged substantially horizontally in a longitudinal direction of the vehicle body;

a hopper mounted to an upper surface of the housing of the crusher, said hopper including a plurality of vehicle panels, a maintenance opening formed in one of the vehicle panels, and a door secured to the maintenance opening for opening and closing the maintenance opening, said vehicle panels each having a vertical attitude such that a worker on the vehicle body cannot enter the hopper except through the door secured to the maintenance opening;

a sensor provided for detecting an opening operation of the door; and a crusher motor unit for driving the pair of rotational shafts of the crusher;

a crusher motor unit controller for outputting one of: (i) a first control signal for controlling the crusher motor unit to rotate in a forward direction, (ii) a second control signal for controlling the crusher motor unit to rotate in a reverse direction, and (iii) a third control signal for controlling the crusher motor unit to stop rotating;

wherein operation of the crusher motor unit is stopped responsive to a signal from the sensor indicating that the sensor has detected an opening operation of the door, regardless of the control signal output by the crusher motor unit controller.

2. A self-advancing crushing machine according to claim 1, wherein said plurality of vehicle panels comprises a front vertical panel, a rear vertical panel, a left vertical panel and a right vertical panel, and wherein the maintenance opening is formed in the rear vertical panel.

3. A self-advancing crushing machine according to claim 2, wherein the vertical attitude of the rear vertical panel is higher than that of the front vertical panel, the left vertical panel and the right vertical panel.

4. A self-advancing crushing machine according to claim 3, wherein the crusher motor is arranged adjacent to the rear vertical panel.

5. A self-advancing crushing machine according to claim 4, wherein a belt conveyor is arranged on the vehicle body between the pair of bilateral travelling members and below the front panel of the crusher.

6. A self-advancing crushing machine according to claim 1, wherein a belt conveyor is arranged on the vehicle body between the pair of bilateral travelling members and below the crusher.

7. A self-advancing crushing machine comprising:

a vehicle body;

a travelling structure mounted to the vehicle body;

a crusher mounted to the vehicle body and having a rotational shaft arranged horizontally and adapted to support a rotational blade;

a crusher motor unit having an output shaft mechanically coupled to the rotational shaft of the crusher;

a vehicle body side support structure fixedly secured to the vehicle body; and a support member fixed to the crusher motor unit and adapted to support the crusher motor unit on the vehicle body through a mechanical coupling with said vehicle body side support structure.

8. A self-advancing crushing machine according to claim 7, wherein said vehicle body side support structure comprises a pair of brackets fixed to the vehicle body, and wherein said support member fixed to the crusher motor unit is fitted to said brackets so as to secure the crusher motor unit to the vehicle body.

9. A self-advancing crushing machine according to claim 7, wherein said support member comprises a reaction force receiving plate.

10. A self-advancing crushing machine according to claim 7, further comprising:

a hopper mounted to an upper surface of a housing of the crusher, said hopper including a plurality of vehicle panels, a maintenance opening formed in one of the vehicle panels, and a door secured to the maintenance opening for opening and closing the maintenance opening, said vehicle panels each having a vertical attitude such that a worker on the vehicle body cannot enter the hopper except through the door secured to the maintenance opening; and a sensor provided for detecting an opening operation of the door;

wherein operation of the crusher motor unit is stopped responsive to a signal from the sensor indicating that the sensor has detected an opening operation of the door.

11. A self-advancing crushing machine according to claim 10, wherein said plurality of vehicle panels comprises a front vertical panel, a rear vertical panel, a left vertical panel and a right vertical panel, and wherein the maintenance opening is formed in the rear vertical panel.

12. A self-advancing crushing machine according to claim 11, wherein the vertical attitude of the rear vertical panel is higher than that of the front vertical panel, the left vertical panel and the right vertical panel.

13. A self-advancing crushing machine according to claim 10, wherein a belt conveyor is arranged on the vehicle body between a pair of bilateral travelling members and below the crusher.

14. A self-advancing crushing machine according to claim 12, wherein the crusher motor is arranged adjacent to the rear vertical panel.

15. A self-advancing crushing machine according to claim 14, wherein a belt conveyor is arranged on the vehicle body between a pair of bilateral travelling members and below the front panel of the crusher.

* * * * *